United States Patent [19]

Buescher

[11] Patent Number: 4,815,654

[45] Date of Patent: Mar. 28, 1989

[54] ENVELOPE HAVING A REMAILABLE PORTION

[75] Inventor: Eugene J. Buescher, Lake St. Louis, Mo.

[73] Assignee: William R. O'Meara, Florissant, Mo. ; a part interest

[21] Appl. No.: 114,629

[22] Filed: Oct. 28, 1987

[51] Int. Cl.[4] ..... B65D 27/06

[52] U.S. Cl. ..... 229/73

[58] Field of Search ..... 229/73; 206/610

[56] References Cited

U.S. PATENT DOCUMENTS

| | | | |
|---|---|---|---|
| 1,142,349 | 6/1915 | Merrill | 206/610 |
| 1,589,714 | 6/1926 | Overly . | |
| 1,803,348 | 5/1931 | Pasurka . | |
| 2,877,944 | 3/1959 | Hyman | 229/73 |
| 2,927,723 | 3/1960 | Johnson | 229/86 |
| 2,931,559 | 4/1960 | Hilliard | 229/73 |
| 2,964,233 | 12/1960 | McFarland | 229/73 |
| 2,983,431 | 5/1961 | Turin | 229/92.3 |
| 3,062,431 | 11/1962 | Rabenold | 229/73 |
| 3,152,751 | 10/1964 | Hiersteiner | 229/73 |
| 3,182,894 | 5/1965 | Doyle et al. | 229/92.7 |
| 3,184,150 | 5/1965 | Hubbard | 229/73 |
| 3,197,121 | 7/1965 | Hayes, Jr. | 229/92.1 |
| 3,227,360 | 1/1966 | Krueger | 229/73 |
| 3,228,586 | 1/1966 | Hayes, Jr. | 229/73 |
| 3,270,948 | 9/1966 | Donovan | 229/73 |
| 3,312,385 | 4/1967 | Amort | 229/73 |
| 3,379,363 | 4/1968 | Sutphen, Jr. | 229/85 |
| 3,411,699 | 11/1968 | Pine et al. | 229/73 |
| 3,428,237 | 2/1969 | Dowen | 229/69 |
| 3,498,528 | 3/1970 | Klein | 229/73 |
| 3,507,519 | 4/1970 | McNabb | 282/25 |
| 3,525,469 | 8/1970 | Sawdon | 229/73 |
| 3,552,641 | 1/1971 | Bell | 229/73 |
| 3,554,381 | 1/1971 | Van Malderghem | 229/69 |
| 3,558,041 | 1/1971 | Buescher | 229/85 |
| 3,711,012 | 1/1973 | Cytron | 229/92.7 |
| 3,747,837 | 7/1973 | Wilson | 229/73 R |
| 3,952,942 | 4/1976 | O'Leary et al. | 229/73 |
| 4,190,162 | 2/1980 | Buescher | 229/73 |
| 4,334,618 | 6/1982 | Buescher | 229/73 |
| 4,403,696 | 9/1983 | Newell | 229/73 |
| 4,418,865 | 12/1983 | Bowen | 229/69 |
| 4,715,530 | 12/1987 | Leese et al. | 229/73 |

FOREIGN PATENT DOCUMENTS

| | | | |
|---|---|---|---|
| 2031846 | 4/1980 | United Kingdom | 206/610 |

OTHER PUBLICATIONS

Linen Supply News Jan., 1972 (5348) Fast-Form Statements Speed Standard's Mail.

Hamilton Copy of two-way envelope.

"Gwen B. Giles" Mailer sample.

*Primary Examiner*—Stephen P. Garbe

[57] ABSTRACT

A mailing envelope that has a closure flap and is provided with lines of perforations that divide the envelope into separable two portions, one of which is usable as a mailable envelope. The perforations are spaced from edges of the envelope so that the envelope resists inadvertent breaking along the lines of perforations during stuffing and handling during mailing.

31 Claims, 3 Drawing Sheets

FIG. 2
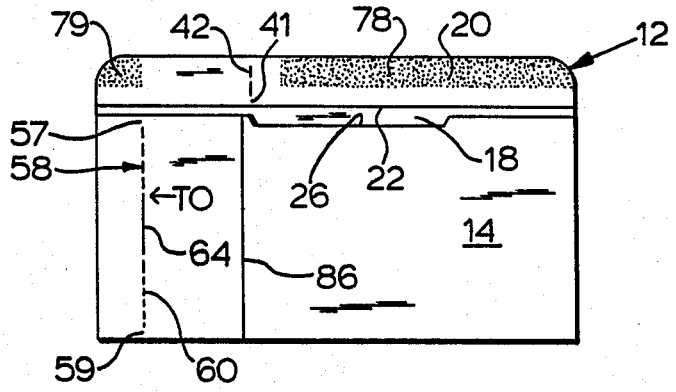
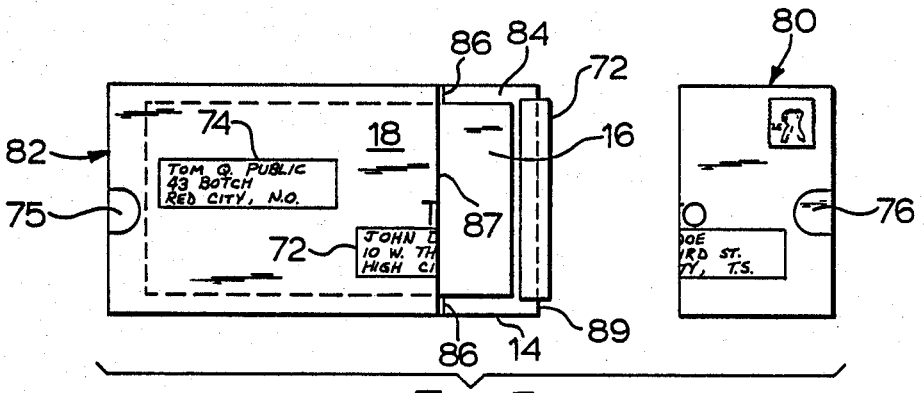
FIG. 5
FIG. 7
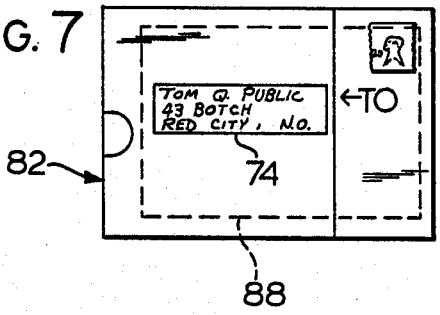
FIG. 6
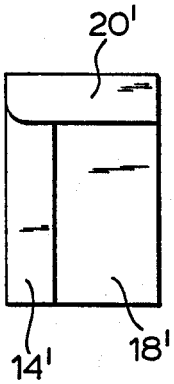
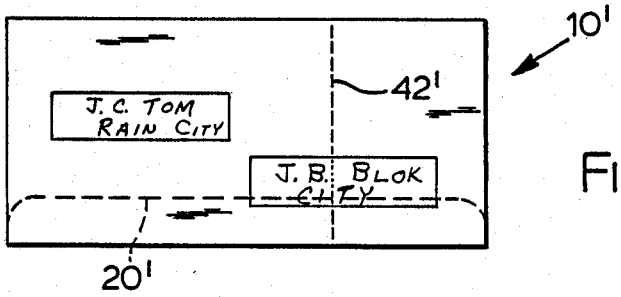
FIG. 8

ENVELOPE HAVING A REMAILABLE PORTION

BACKGROUND OF THE INVENTION

This invention relates to envelopes having remailable portions and more particularly to an envelope with a remailable portion having an opening with a closure flap.

Mailing envelopes in which a portion of the envelope provides a remailable portion upon opening the envelope have been used for some time. The advantages of this type of envelope include, in addition to other advantages, substantial reductions in the material required, cost of material, and waste material, and provides confidentiality. For example, in the Buescher patents, U.S. Pat. Nos. 4,190,162 and 4,334,618 mailing envelopes are having perforations on the back and front sides such that the envelope separates at the perforations upon opening into a reusable portion which forms a mailable envelope and a relatively small disposable portion. The perforations are predeterminately located such that the reusable portion of the original envelope is formed with a closure flap so that the reusable portion can be closed and mailed with an insert or letter.

While the above types of envelopes have been commercially successful, it has been found that in some cases where the envelope is designed so that the original envelope has an opening with a flap such that it can be hand or automatically stuffed with an insert, the envelope can be damaged during stuffing due to the inadvertent partial bursting of one or more perforations. Also, in some cases, the perforations have either tended to require an excessively large pulling or snapping force to open the envelope or have been made so weak the envelope is subject to damage during handling and mailing due to undesired bursting of a perforation.

SUMMARY OF THE INVENTION

It is therefore an object of the present invention to provide an envelope having an opening with a closure flap which separates at lines of perforation upon opening into a reusable portion suitable for mailing which substantially avoids one or more of the above mentioned disadvantages or problems.

Another object is to provide an envelope having an opening with a closure flap that can be hand or automatically stuffed and that separates into a mailable envelope portion and a discardable portion, and which mailable portion has a closure flap for closing the mailable portion, and wherein the original envelope can be readily stuffed and mailed without damage and yet the original envelope can be readily opened.

In accordance with one aspect of the invention an original envelope is provided with an opening with a closure flap and tear perforation lines on the back and front sides which after the envelope is closed can be separated at the perforation lines into a reusable mailing envelope and a discardable portion. The perforation lines are relatively related so that the reusable mailing envelope has an opening with a closure flap. The perforations extend on the back and front sides of the original envelope between its upper and lower edges but at least one of the ends of the perforation lines are spaced from one of the edges of the envelope.

In accordance with another aspect of the invention an envelope of the above mentioned type is provided with a line of perforations on the back side of the original envelope which breaks more easily than the line of perforations of the front side, the back containing a slit substantially longer than any other perforation on the back side.

In accordance with another aspect of the invention an envelope is provided having an opening with a closure flap and perforation lines located such that the envelope separates into a reusable mailing portion having a closure flap and a discardable portion. A portion of the front line of perforations extend through a mailing address zone with the perforations in that zone being smaller in size than in other zones of the front side to permit a mailing address to be hand written across perforations in the mailing address zone.

In accordance with still another aspect of the invention, an original envelope is provided having an opening with a closure flap and front and back perforation lines located such that the envelope separates into a reusable mailing portion having a closure flap and a discardable portion. The closure flap of the reusable mailing portion has an area of adhesive for sealing the flap closed. The area of adhesive is covered by a peel-away tape having an outer surface that is relatively slick compared to the paper of the envelope and is located such that during the opening of the original envelope pinching pressure is applied to the slick surface of the tape to reduce the force necessary to open the original envelope.

These as well as other objects and advantages of the present invention will become apparent from the following description and accompanying drawings.

BRIEF DESCRIPTION OF THE DRAWINGS

FIG. 2 is a back plan view of the envelope of FIG. 1 but with the closure flap open;

FIG. 5 is a front plan view showing the envelope of FIG. 1 after it has been opened;

FIG. 6 is a back plan view of the discardable portion of the envelope of FIG. 5;

FIG. 7 is a front plan view of the reusable portion of the envelope of FIG. 1 closed for mailing;

FIG. 8 is a plan view showing a modified embodiment of an envelope like that of FIG. 1 but with the closure flap connected to the bottom of the front panel;

DESCRIPTION OF THE PREFERRED EMBODIMENTS

Figure 1:
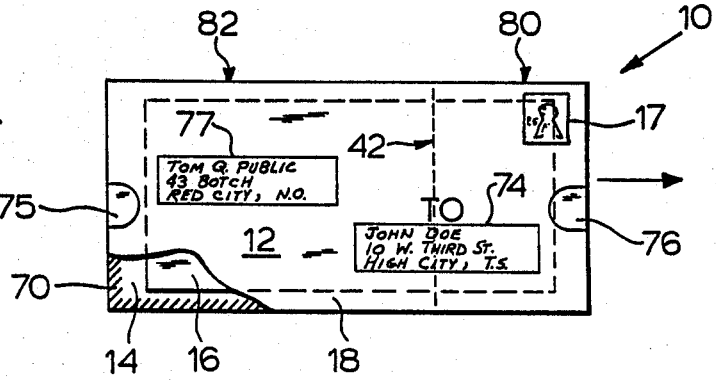
FIG. 1 is a front plan view of an envelope in accordance with one embodiment of the present invention.

Referring now to the drawings and especially to FIGS. 1–4, there is shown in FIG. 1 a mailing envelope 10 made in accordance with the present invention. Envelope 10 includes front and back panel members 12 and 14, respectively, connected together and shown with an insert such as a letter 16 inside the envelope and with the envelope closed, addressed, and ready for mailing. The front panel member 12 includes a rectangular front sheet or panel 18 and a flap 20, as seen in FIG. 2, integrally connected at a fold line or crease 22 to the upper edge or side of panel 18. The back panel member 14 has a recess 26 in the top margin adjacent the closure flap 20. The recess 26 permits the fingers (or a mechanical device if used) to be readily inserted into the interior of the envelope to expand it during stuffing such as during the insertion of a paper sheet, for example, the insert 16.

Figure 3:
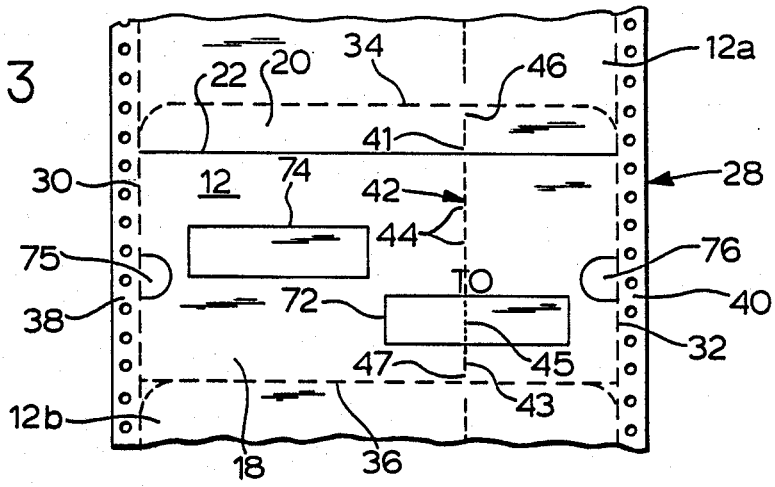
FIG. 3 is a plan view of a continuous paper strip used in the manufacture of the front panel member of the envelope of FIG. 1.

The front panel member 12 of envelope 10 may be formed in a paper strip or sheet 28 as shown in FIG. 3, along with identical panel members, such as adjacent panels 12*a* and 12*b*, for making a plurality like envelopes. The outer side of the front panel 12 is shown in FIG. 3. Member 12 is defined, as viewed in FIG. 3, by left and right longitudinally extending lines of perforations 30 and 32, and upper and lower lines of perforations 34 and 36 and is generally rectangular in shape. A vertically extending tear line 42 of perforations extends substantially from the bottom edge, as defined by perforation line 36, to the upper edge as defined perforation line 34 but the lowermost perforation and the uppermost perforation are adjacent to but spaced from the upper and lower edges of the panel member. That is, the perforation line 42, which is made up of small slits or perforations 43 spaced by ties or uncut paper areas 44, and an intermediate series of fine perforations 45 are predeterminately located in panel member 12 such that unperfed areas 46 and 47 will be at the upper and lower edges of the panel member adjacent perforations 34 and 36. Also, an unperfed area 41, as best seen in FIG. 2, extends across the fold line or crease 22 at the upper side of panel 18 and into flap 20. In this way, there are no slits or perforations intersecting the upper and lower edges or sides of front panel 18, the free edge of the flap 20 or the fold line 22 so that the finished envelope has good resistance against inadvertent damage or bursting of perforation lines during the stuffing of the envelope 10 and handling during mailing. The perforations of series 45 are substantially finer or smaller in length than other perforations of line 42 as will be discussed hereafter.

Right end and left end drive strips 38 and 40 are provided for advancing the paper strip 28 through suitable perforation forming wheels or dies. Preferably a cylindrical rotatable die (not shown) having perforation-effecting elements is used so as to produce the perforations lines in sheet 28 so that the lines and perforations are thereby predeterminately related in each front panel and ensuring that unperfed areas 41, 46 and 47 are located as indicated.

Figure 4:
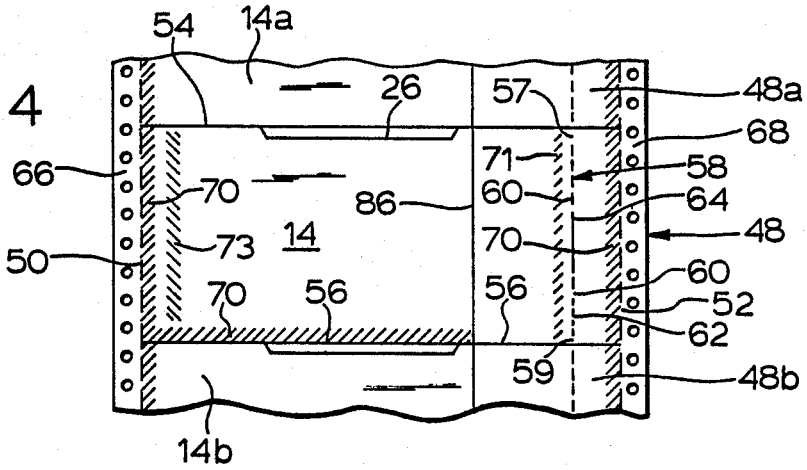
FIG. 4 is a plan view of a strip used in the manufacture of the back panel member of the envelope of FIG. 1.

The back panel 14 is shown in FIG. 4 formed in a paper strip or sheet 48 along with adjacent identical panels 48 and 48*b*. The inner side of panel 14 is shown in FIG. 4. It is defined by left and right perforation lines 54 and 52, and upper and lower edges or die cut lines 54 and 56 and is generally rectangular in shape. Upper edge 54 is recessed downwardly to form the recess 26. A line of perforations 58 which is close to but spaced from the right line of perforation 52 and extends substantially from the upper to the lower edges or sides 54 and 56 but the uppermost and lowermost perforations are respectively spaced from the upper and lower edges leaving unperfed areas 57 and 59 at the edges. The perforation line 58 is made of perforations 60 and ties 62 between perforations, and a long perforation or slit 64. Between the left and right edges of the paper strip 48 and the left and right perforation lines 50 and 52 are opposed drive strips 66 and 68 having drive holes for moving the strip 48 through perforation forming wheels or die cutting apparatus.

The back panel 14 is provided with an adhesive 70 along the left, bottom and right margins. The back panel 14 is applied to the inner side of panel 18 with the adhesive 70 securing the panels together to form the envelope 10 (FIGS. 1 and 2). A plurality of envelopes may be formed together to form individual envelopes. Some or all of the drive strips may be stripped from the envelopes and discarded if desired. The adhesive 70 seals the panels together and may be applied in various manners, the adhesive 70 being shown on the back panel for the sake of clarity.

Back panel 14 is also provided with a strip of adhesive 71, preferably, of the non-drying type and which is covered by a peel-away cover strip 72, as shown in FIG. 5 and which also covers the perforation line 58. Adhesive 71, after cover strip 72 is removed, is used to seal the return envelope as will be discussed hereafter. Another line of adhesive 73, is shown in FIG. 4 which extends vertically adjacent to but spaced from the left side or marginal perforation line 50. Adhesive 73 seals the panels 14 and 18 together along this adhesive strip to space any insert, such as insert 16, from the left side of the envelope as will be explained hereafter.

After the envelope 10 is formed by the panel members 12 and 14, it can be stuffed such as by expanding the envelope and inserting insert 16. As previously mentioned, the envelope 10 resists bursting of the perforation lines 42 and 58 at either end since there are no slits or perforations at the upper and lower edges or sides of the panels 14 and 18, flap 20 or at the fold crease 22. Also, cover strip 72 which is preferably of slick material such as of a plastic or the like, prevents the insert 16 from entering slit 64 or otherwise breaking tear perforation line 58 of the back panel 14. In the embodiment shown in FIG. 1, the insert 16 may extend under the pinch area 76 depending upon its size, so that during the opening of the envelope 10 the right end of the insert will readily slide over the slick surface of cover tape 72 tending to reduce friction and reduce opening effort. The cover tape also tends in general to maintain the back panel perforation line 58 uncreased during handling. The adhesive 73 (FIG. 4) locates the insert 16 so that the left end of the insert is not pinched by the fingers while opening envelope 10. The adhesive 73 could be located instead just to the right of perforation line 58 in FIG. 4 to maintain the right end of insert 16 out of the right pinch area 76 if desired. It is, of course, desirable to pinch the insert at only one end or not at all.

As seen in FIG. 1, the front panel 18 is provided with left and right thumb grasping indicia indicated at 75 and 76 which are pinched between the thumb and index finger during the opening of envelope 10. Also printed mailing address and return address boxes 74 and 77 on the outer side of front panel 18 indicate the areas in which the original mailing address and return address are to be located. Addresses are shown in these boxes for illustration.

The flap 20, as seen in FIG. 2, is provided with adhesive 78 along the flap between the line of perforations 42 and the left end of the envelope (as viewed in FIG. 1), and adhesive 79 laterally between the right edge of the flap and line of perforations 60 on the back panel 14. Adhesive 78 and 79 is wetted and the flap 20 folded along fold line 22 to close the envelope 10. The flap 20 is shown with no adhesive between the tear perforation line 42 of the front panel member 12 and the tear perforation line 58 of the back panel 14 to permit the opening of the envelope 10 by pulling or snapping the right hand portion of the envelope indicated at 80 from the left hand portion indicated at 82 in FIG. 5. The adhesive areas 78 and 79 are preferably colored to contrast it with the envelope so that it will be obvious to the person using the envelope to employ both adhesive area 78 and 79 when sealing the envelope 10.

When opening the envelope 10, as shown in FIG. 1, it is grasped or pinched between the thumb and forefinger at the indicia shown at 75 and 76 and pulled or snapped apart to provide the envelope portions 80 and 82. The portions 80 and 82 separate along the tear perforation line 42 on the front panel 18 and flap 20 and the tear perforation line 58 on the back panel 14. Each of the portions 80 and 82 include a portion of the back panel 14 and a portion of the front panel 18 as well as portions of the flap 20. The back side of envelope portion 80 is shown in FIG. 6 and includes a portion 20' of the flap 20, a portion 14' of back panel 14 and a portion 18' of front panel 18. The other portions of the front and back panels 14 and 18 and flap 20 form the portion 82 which is usable as a mailing envelope. The insert 16 can be removed from portion 80 and the portion 82 discarded as waste.

The fine series of perforations 45 of front perforation line 42 are small enough to readily allow smooth hand writing across them with a ball-point pen or the like and without tearing or breaking the perforation line.

Because the front and back perforation lines 42 and 58 are laterally offset from each other, the perforation 58 being offset to the right of perforation line 42, an end closure flap 84 is formed upon opening of the original envelope 10. The end flap 84 is a portion of back panel 14 and is foldable along crease or fold line indicated at 86 in FIGS. 4 and 5 for closing the formed mailing envelope 82. Thus, the formed envelope 82 has an opening at the right edge 87 of the front panel portion for inserting another insert 88 (FIG. 6) into the pocket formed by the front and back portions of panels 12 and 18 of envelope portion 82. The right edge 87 being formed by the breaking of perforation line 42 and the right edge 89 of the back panel being formed by the breaking of perforation line 58.

After inserting the insert 88 in the formed envelope 82, the cover strip 72 (FIG. 5) is peeled from adhesive 71 exposing adhesive 71 (FIG. 4). The flap 84 is folded on crease 86 to seal the right edge of the flap to the front side of the front panel portion of the formed envelope 82.

The original mailing address area 72 is located so that the perforation line 42 intersects the mailing address and preferably passes through the lateral center of the mailing address area 72. In this way, about one-half of the mailing address is discarded with portion 80 and the other half is covered by the formed end flap 84 when closing formed envelope 82. In this way the reusable portion or envelope 82 is maximized in size relative to the original envelope 10. With the original mailing address eliminated as in FIG. 6, the return address in the return address area 74 becomes the new mailing address for formed envelope 82. With proper postage, the formed envelope may be placed in the mail.

The original envelope 10 could be provided with an insert that is adhesively connected at the right end portion 80 so that it is removed with the portion 80 and automatically removed from the left reusable portion 82. Also, where desired, instead of employing non-drying adhesive and cover strip 72, wettable glue alone could be used where desired. The front and back panel members 12 and 14 can be made of various kinds and weights of paper, for example, the front panel could be made from 24 lb. bond paper and the back panel from 20 lb. bond paper.

Original envelopes like envelope 10 can be made with the closure flap at the bottom. For example, if an envelope 10' like envelope 10 is turned up-side down or rotated 180 degrees on its longer axis, and addressed as shown in FIG. 8 instead of as shown in FIG. 1, a flap 20' like flap 20, will be at the bottom. In some cases, for example, where the envelope, indicated at 10' is passed through printing mechanisms it may be desirable to have the closure flap at the bottom to prevent the flap from interfering with such mechanisms. The flap is shown in phantom at 20' in FIG. 8 and the front perforation line at 42'.

Figure 9:
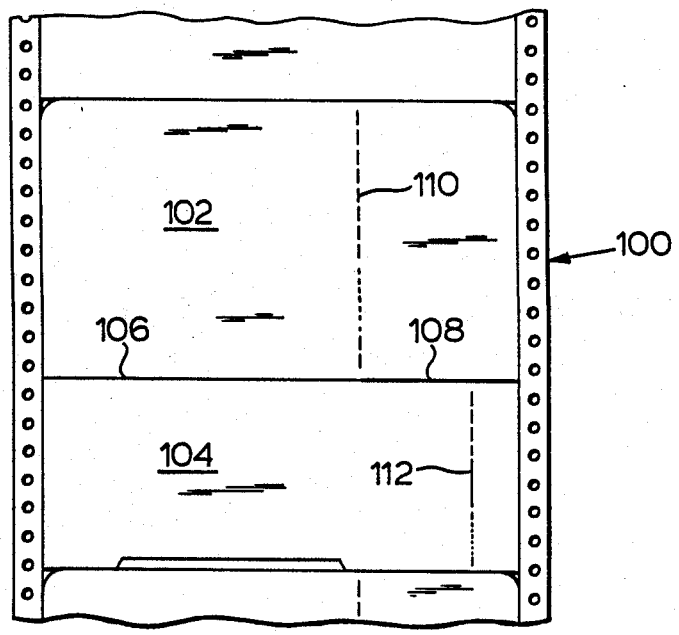
FIG. 9 is a plan view of a paper strip showing modified front and back panels integrally in a paper strip.

FIG. 9 shows a modified construction including a continuous paper strip 100 having a front panel 102 like panel 12 and a back panel 104 like panel 14 but with the two panels connected together at a fold or crease line 106. The back panel can be folded back against the bottom side (not shown) of the front panel to form a completed envelope like envelope 10 except that the two panels 102 and 104 will be integrally connected together at the bottom edge. The fold line 106 connects with a die cut at 108 to allow the envelope to separate on perforation lines 110 and 112 on the front and back panels when the panels are adhesively connected together in the manner on which the front and back panels of envelope 10 are connected together.

Figure 10:
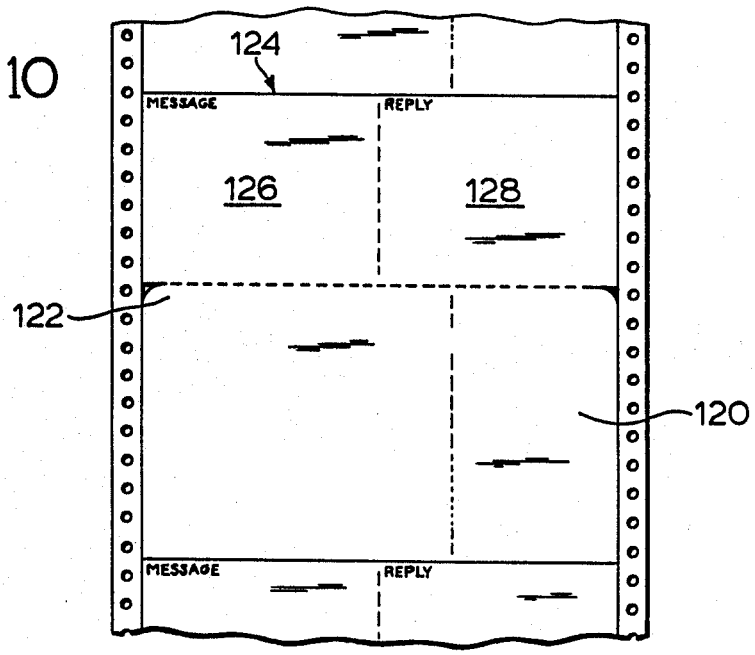
FIG. 10 is a plan view of a paper strip in which a modified front panel is provided with removable writing sheet connected to the flap of front panel member.

FIG. 10 shows another embodiment in which a front panel 120 is formed like the front panel of envelope 10 having a tear line of perforations 42 but has connected to its flap 122 by a line of perforations 123 a writing sheet 124 divided into a message portion 126 and a reply portion 128 by a line of perforations 129. A back panel like panel 14 of envelope 10 can be secured to panel 120 to form a mailing envelope like envelope 10. The writing sheet can be broken away from panel 120 and provided with a message on portion 126 and folded for insertion in the original envelope. When the envelope is snapped open (in the same manner as envelope 10), the reply portion 128 can be provided with a message or information and returned in the formed or reusable envelope portion.

During the stuffing of the envelope 10, considerable forces may be exerted on the unperforated areas 46 and 57 however since these areas do not have a slit or perforation, the envelope greatly resists tearing o breaking of the tear lines 42 and 58. The unperforated areas 41, 47, and 59 also resist forces tending to tear lines of perforations 42 and 58 and this resistance is especially important after the envelope is closed and mailed.

It is to be understood that the foregoing description and accompanying drawings have been given only by way of illustration and example and that alterations and changes that are apparent to one skilled in the art are contemplated as within the scope of the present invention which is limited only by the claims which follow.

What is claimed is:

1. A reusable envelope comprising front and back panels each having opposed ends and opposed sides, the opposed ends of said front panel being connected respectively to the opposed ends of said back panel, one of said opposed sides of said front panel being connected to one of the opposed sides of said back panel, a first closure flap for closing the reusable envelope having one side integrally connected to one of said sides of one of said panels an having an opposed free side, said front and back panels having first and second tear lines of perforations, respectively, extending between said opposed sides of said panels with the line of perforations on said one panel extending into said flap, one of said lines of perforations being spaced from at least one of said sides of the panel on which it extends to resist premature tearing thereof, said lines of perforations being laterally offset from each other dividing the reusable envelope into two envelope portions, first adhesive means on said first closure flap for adhesively connecting areas of said first flap to areas of said other panel for closing the reusable envelope, said envelope portions after the reusable envelope is closed being separable from each other at said tear lines of perforations when opening the reusable envelope with one of said envelope portions providing a formed envelope with a second closure flap, facing areas of said panels between said lines of perforations being substantially unattached to each other and said first flap being substantially unattached to areas of said other panel between said lines of perforation after the reusable envelope is adhesively closed by said first flap to allow the separation of said envelope portions when the reusable envelope is opened, and second adhesive means on said second closure flap for adhesively closing said formed envelope.

2. The envelope of claim 1 wherein said tear line of perforations on said one panel is spaced from the free side of said flap.

3. The envelope of claim 1 wherein said second tear line of perforations is spaced from said one side of said back panel.

4. The envelope of claim 1 wherein said first line of perforations is spaced from said one side of said front panel.

5. The envelope of claim 1 wherein said first flap is connected to the other of said sides of said front panel at a fold line, said first tear line of perforations is spaced from said fold line with none of the perforations intersecting said fold line.

6. The envelope of claim 5 wherein said first tear line of perforations is spaced from the free edge of said flap.

7. The envelope of claim 6 wherein said first tear line is spaced from said one side of said front panel.

8. The envelope of claim 7 wherein said first tear line of perforations is spaced from said other edge of said front panel.

9. The envelope of claim 1 wherein said second tear line of perforations includes a slit longer than any other perforation thereof.

10. The envelope of claim 1 wherein the closure flap of the formed envelope has a non-dryable adhesive thereon, and a peel-away cover strip having a slick surface covering said adhesive and at least a portion of said second line of perforations.

11. The envelope of claim 1 wherein said front panel has a mailing address area intersected by said first tear line of perforations, and said first tear line of perforations has a series of perforations smaller than other perforations thereof located in said mailing address area.

12. The envelope of claim 1 including a line of adhesive connecting said front and back panels together adjacent one end thereof to space an insert from said one end.

13. The envelope of claim 1 wherein none of the perforations of said second line of perforations intersects any of said sides of said back panel.

14. The envelope of claim 1 wherein none of the perforations of said first line of perforations intersects any of said sides of said front panel.

15. The envelope of claim 14 wherein none of the perforations of said second line of perforations intersects any of said sides of said back panel.

16. The envelope of claim 15 wherein said second line of perforations includes a slit linger than any perforation of said second line of perforations.

17. The envelope of claim 1 wherein said front panel has a mailing address area thereon, and said first line of perforations extends through said mailing address area.

18. The envelope of claim 17 wherein said front panel includes a return address area latterly spaced from said mailing address area such that said second flap when closing said formed envelope covers said part of the mailing address area but not the return address area.

19. The envelope of claim 17 further including a message sheet connected to one of said panels by a third tear line of perforations.

20. The envelope of claim 1 wherein said one opposed side of said back panel is integrally connected to said one opposed side of front panel along a fold line, and said fold line has a slit extending laterly between said first and second lines of perforations.

21. The envelope of claim 1 wherein said panels are discreet paper sheet members connected together at said opposed ends and along said one sides thereof by adhesive means, and said lines of perforation are substantially straight lines of perforations.

22. A reusable envelope comprising front and back panels each having left and right end edges and upper and lower side edges, said panels being connected together adjacent the left and right edges and adjacent one of the side edges of the panels to provide a pocket for receiving an element to be mailed, a first closure flap having a free side edge and integrally connected to said front panel along an opposed side edge thereof and adapted to be folded over said back panel for closing the reusable envelope, said front and back panels having first and second tear lines of perforations, respectively, extending substantially vertically between the side edges of said panels with said first line of perforations extending into said first closure flap, one end of one of said lines of perforations extending close to but spaced from one of said edges, said first and second lines of perforations being laterally offset from each other with said first line of perforations spaced farther from said right edges than said second line of perforations to divide the reusable envelope into right and left envelope portions, first adhesive means on said first closure flap extending laterally between the left end thereof and said first line of perforations and laterally between the right end thereof and said second line of perforations so that said first closure flap adheres to aeas of said back panel in areas thereof to the left of said first line of perforations and to the right of said second line of perforations when said first closure flap is adhereingly closing the reusable envelope, said envelope portions being spearable at said first and second lines of perforations when said portions are pulled apart to open the reusable envelope, the facing areas of said first flap and said back panel and the facing areas of said front and back panels between said first and second lines of perforations when said first closure flap is adhesively closing said reusable envelope being substantially unattached to each other to allow movement between said facing areas during the opening of the reusable envelope, said left envelope portion including parts of said front and back panels and part of said first closure flap with a portion of said back panels part extending rightwardly beyond the right end of said front panel part to provide a second closure flap for closing said left envelope portion and having a free edge, second adhesive means on said second closure flap adjacent to said free edge thereof for adhesively connecting it to said front panels part when closing said left envelope portion.

23. The envelope of claim 22 wherein said one edge is the free side edge of said flap.

24. The envelope of claim 22 wherein said one edge is the lower edge of said front panel.

25. The envelope of claim 22 wherein said front panel includes mailing address means located to be intersected by said first line of perforations.

26. The envelope of claim 25 wherein said front panels includes return address means spaced leftwardly from the free edge of said second closure flap when said left envelope portion is adhesively closed by said second closure flap.

27. The envelope of claim 26 wherein said first line of perforations extends close to but is spaced from the upper and lower edges thereof and the opposed edge o said first closure.

28. The envelope of claim 27 wherein said second line of perforations extends close to but is spaced from the upper and edges thereof.

29. The envelope of claim 28 wherein the front and back panels comprise a single sheet member folded along one edge of each panels to form said front and back panels.

30. The envelope of claim 28 wherein said first line of perforations includes a series of perforations within said mailing address means smaller in length than other perforations of said first line of perforations.

31. The envelope of claim 22 wherein said first adhesive means has a color in contrast with the color of the reusable envelope.

* * * * *